US011194275B2

(12) United States Patent
Takemasa et al.

(10) Patent No.: US 11,194,275 B2
(45) Date of Patent: Dec. 7, 2021

(54) FIXING DEVICE

(71) Applicant: Canon Kabushiki Kaisha, Tokyo (JP)

(72) Inventors: Rikiya Takemasa, Chiba (JP); Youichi Chikugo, Chiba (JP); Hidekazu Tatezawa, Saitama (JP); Kenichi Tanaka, Ibaraki (JP); Yutaro Tsuno, Tokyo (JP); Mitsuru Hasegawa, Ibaraki (JP); Hiroki Kawai, Chiba (JP); Suguru Takeuchi, Chiba (JP); Ayano Ogata, Ibaraki (JP); Yasuharu Toratani, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/123,793

(22) Filed: Dec. 16, 2020

(65) Prior Publication Data

US 2021/0191299 A1 Jun. 24, 2021

(30) Foreign Application Priority Data

Dec. 18, 2019 (JP) ..... JP2019-228644

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
CPC ..... G03G 15/2017; G03G 15/2053; G03G 15/2064; G03G 2215/2003; G03G 2215/2038
See application file for complete search history.

(56) References Cited

U.S. PATENT DOCUMENTS 7,890,024 B2 2/2011 Hirayama et al. ..... 399/122
7,890,038 B2 2/2011 Chikugo et al. ..... 399/323
(Continued)

FOREIGN PATENT DOCUMENTS

JP 2014-228765 A 12/2014
JP 2017-37267 A 2/2017

OTHER PUBLICATIONS

U.S. Appl. No. 17/123,773, filed Dec. 16, 2020 Title: Fixing Device Inventors: Rikiya Takemasa Chiba, (JP) Hidekazu Tatezawa Saitama, (JP) Yutaro Tsuno Tokyo, (JP) Kenichi Tanaka Ibaraki, (JP) Youichi Chikugo Chiba, (JP) Mitsuru Hasegawa Ibaraki, (JP) Hiroki Kawai Chiba, (JP) Suguru Takeuchi Chiba, (JP) Ayano Ogata Ibaraki, (JP) Yasuharu Toratani Chiba, (JP).
(Continued)

*Primary Examiner* — Thomas S Giampaolo, II
(74) *Attorney, Agent, or Firm* — Venable LLP

(57) ABSTRACT

A toner image fixing device include a fixing belt; a heating roller training the belt around; a pressing pad of resin material provided inside the belt; a rotatable pressing member contacting the belt and pressing against the pad through the belt to form a nip for nipping and feeding the sheet; a supporting stay supporting the pad and including a surface contacting the pad, one of the pad and the stay being provided with a projection, and the other being provided with a recess engaged with the projection at an engaging position; and a separation plate provided without contact to the belt at a position opposed to the pad downstream of the nip in the sheet feeding direction. A distance between the engaging position and a downstream end of the pad is 0-35% of a length of the pad measured along the feeding direction.

9 Claims, 10 Drawing Sheets

(56) References Cited

U.S. PATENT DOCUMENTS

| | | | | |
|---|---|---|---|---|
| 8,005,414 | B2 | 8/2011 | Hasegawa | 399/331 |
| 8,655,242 | B2 | 2/2014 | Tanaka | 399/323 |
| 8,712,272 | B2 | 4/2014 | Takeuchi et al. | 399/69 |
| 8,818,254 | B2 | 8/2014 | Arimoto et al. | 399/329 |
| 8,862,009 | B2 | 10/2014 | Takeuchi et al. | 399/69 |
| 8,909,114 | B2 | 12/2014 | Takeuchi | 399/329 |
| 8,917,999 | B2 | 12/2014 | Takada et al. | 399/43 |
| 8,918,003 | B2 | 12/2014 | Kawai et al. | 399/69 |
| 8,929,762 | B2 | 1/2015 | Shinagawa et al. | 399/69 |
| 8,942,612 | B2 | 1/2015 | Tanaka | 399/330 |
| 8,971,746 | B2 | 3/2015 | Hasegawa et al. | 399/67 |
| 8,983,325 | B2 | 3/2015 | Takeuchi | 399/69 |
| 8,989,640 | B2 | 3/2015 | Kitagawa et al. | 399/320 |
| 9,026,020 | B2 | 5/2015 | Chikugo | 399/322 |
| 9,057,993 | B2 | 6/2015 | Takeuchi et al. | G03G 15/206 |
| 9,069,299 | B2 | 6/2015 | Tanaka | G03G 15/2028 |
| 9,235,168 | B2 | 1/2016 | Kawai | G03G 15/2053 |
| 9,274,467 | B2 | 3/2016 | Takeuchi et al. | G03G 15/2053 |
| 9,329,557 | B2 | 5/2016 | Kitagawa et al. | G03G 15/20 |
| 9,348,292 | B2 | 5/2016 | Chikugo | G03G 15/6573 |
| 9,354,562 | B2 | 5/2016 | Tanaka | G03G 15/2028 |
| 9,367,006 | B2 | 6/2016 | Yoshida et al. | G03G 15/2053 |
| 9,389,554 | B2 | 7/2016 | Tanaka et al. | G03G 15/2021 |
| 9,392,642 | B2 | 7/2016 | Tanaka et al. | H05B 1/00 |
| 9,465,336 | B2 | 10/2016 | Saito et al. | G03G 15/2053 |
| 9,547,262 | B2 | 1/2017 | Hirayama et al. | G03G 15/2039 |
| 9,563,163 | B2 | 2/2017 | Tanaka et al. | G03G 15/502 |
| 9,977,385 | B2 | 5/2018 | Miura et al. | G03G 15/2053 |
| 10,061,242 | B2 | 8/2018 | Tanaka | G03G 15/2032 |
| 10,133,219 | B2 | 11/2018 | Kawai | G03G 15/55 |
| 10,241,433 | B2 | 3/2019 | Tanaka et al. | G03G 13/20 |
| 10,241,455 | B2 | 3/2019 | Fukamachi et al. | G03G 15/2039 |
| 10,437,185 | B2 | 10/2019 | Yamaguchi et al. | G03G 15/5004 |
| 10,564,576 | B2 | 2/2020 | Tanaka et al. | G03G 15/2053 |
| 10,627,751 | B2 | 4/2020 | Hasegawa et al. | G03G 15/2021 |
| 10,719,042 | B2 | 7/2020 | Hirayama et al. | G03G 15/2039 |
| 10,802,430 | B2 | 10/2020 | Toratani et al. | G03G 15/2053 |
| 2013/0142532 | A1 | 6/2013 | Kitagawa et al. | 399/67 |
| 2014/0348558 | A1 | 11/2014 | Inoue et al. | |
| 2017/0045851 | A1 | 2/2017 | Kanai et al. | |
| 2017/0153581 | A1 | 6/2017 | Chikugo | G03G 15/20 |
| 2017/0192387 | A1 | 7/2017 | Tanaka | G03G 15/2039 |
| 2019/0137916 | A1* | 5/2019 | Sonoyama | G03G 15/2064 |
| 2020/0041940 | A1 | 2/2020 | Kawai et al. | G03G 15/2017 |
| 2020/0133174 | A1 | 4/2020 | Kawai et al. | G03G 2215/2038 |
| 2020/0159153 | A1 | 5/2020 | Takemasa | G03G 15/2053 |
| 2020/0218183 | A1* | 7/2020 | Shibuya | G03G 15/2039 |
| 2020/0233353 | A1 | 7/2020 | Tsuno et al. | G03G 15/2053 |
| 2020/0233354 | A1 | 7/2020 | Tatezawa et al. | G03G 15/2064 |
| 2020/0310309 | A1 | 10/2020 | Kawai et al. | G03G 15/2039 |
| 2020/0387094 | A1* | 12/2020 | Yamaguchi | G03G 15/2025 |
| 2021/0072699 | A1 | 3/2021 | Inoue et al. | G03G 15/2017 |

OTHER PUBLICATIONS

U.S. Appl. No. 17/094,077, filed Nov. 10, 2020 Title: Fixing Device Inventors: Hidekazu Tatezawa Saitama, (JP) Youichi Chikugo Chiba, (JP) Rikiya Takemasa Chiba, (JP) Kenichi Tanaka Ibaraki, (JP) Yutaro Tsuno Tokyo, (JP) Mitsuru Hasegawa Ibaraki, (JP) Suguru Takeuchi Chiba, (JP) Hiroki Kawai Chiba, (JP) Yasuharu Toratani Chiba, (JP) Ayano Ogata Ibaraki, (JP).

U.S. Appl. No. 17/160,062, filed Jan. 27, 2021 Title: Recording Material Cooling Device Inventors: Kenichi Tanaka Ibaraki, (JP) Keita Kondo Ibaraki, (JP) Yuki Inoue Ibaraki, (JP) Shingo Katano Ibaraki, (JP).

U.S. Appl. No. 17/160,071, filed Jan. 27, 2021 Title: Recording Material Cooling Device Inventors: Kenichi Tanaka Ibaraki, (JP) Keita Kondo Ibaraki, (JP) Yuki Inoue Ibaraki, (JP) Shingo Katano Ibaraki, (JP).

U.S. Appl. No. 17/123,773, filed Dec. 16, 2020.

U.S. Appl. No. 17/094,077, filed Nov. 10, 2020.

U.S. Appl. No. 17/160,062, filed Jan. 27, 2021.

U.S. Appl. No. 17/160,071, filed Jan. 27, 2021.

* cited by examiner

FIXING DEVICE

FIELD OF THE INVENTION AND RELATED ART

The present invention relates to a fixing device for fixing a toner image, carried on a recording material, on the recording material.

As the fixing device, a constitution in which a nip in which the recording material is nipped and fed between a fixing belt which is an endless belt and a pressing roller contacting an outer peripheral surface of the fixing belt and in which the toner image is fixed on the recording material passing through the nip has been known (Japanese Laid-Open Patent Application (JP-A) 2014-228765). In the case of the constitution disclosed in JP-A 2014-228765, a pad member, made of a resin material, for forming the above-described nip is provided inside the fixing belt so as to oppose the pressing roller. Further, the pad member has a curved surface at a downstream end portion thereof with respect to a recording material feeding direction in the nip and curves the fixing belt by curvature of this curved surface, and in addition, on a side downstream of the nip, a separation plate is provided with a gap from an outer peripheral surface of the fixing belt. By this, a recording material passed through the nip is separated from the fixing belt.

Here, for example, in order to enhance a separation property of a recording material, with a small basis weight such as thin paper, from the fixing belt, a constitution in which the separation plate is provided at a position opposing the pad member through the fixing belt and is brought closer to the fixing belt is employed. In such a constitution, the pad member is heated and thus is thermally expanded. When the pad member is thermally expanded toward the separation plate, in order to prevent contact between the separation plate and the fixing belt, there is a need to separate the separation plate and the fixing belt in advance in consideration of a thermal expansion amount of the pad member. In a constitution in which the thermal expansion amount of the pad member expanding toward the fixing belt increase, there is a need to increase a gap (interval) between the separation plate and the fixing belt in advance. As a result, there is a liability that the separation property is not sufficiently enhanced.

SUMMARY OF THE INVENTION

A principal object of the present invention is to provide a fixing device capable of decreasing a gap between a separation plate and a pad member by reducing a degree of thermal expansion, toward the separation plate, of a pressing pad made of a resin material.

According to an aspect of the present invention, there is provided a fixing device for fixing a toner image on a recording material, the fixing device comprising a rotatable fixing belt; a heating roller including a heater, wherein the belt is entrained around the heating roller to heat the belt; a pressing pad of resin material provided inside of the belt; a rotatable pressing member contacting an outer peripheral surface of the belt and pressing against the pressing pad through the belt to form a nip configured to nip and feed the recording material; a supporting metal stay supporting the pressing pad and including a plate-like contact surface contacting the pressing pad, wherein one of the pressing pad and the supporting stay is provided with a projection, and the other of them is provided with a recess or hole which is engaged with the projection to determine a position of the pressing pad relative to the supporting stay; and a separation plate provided without contact to the belt at a position opposed to the pressing pad with the belt interposed therebetween and downstream of the nip in a feeding direction of the recording material, wherein a distance measured along a widthwise direction of the pressing pad between an engaging position between the projection and the recess or the hole and a downstream end of the pressing pad in the feeding direction of the recording material is larger than 0% and not larger than 35% of an entire length of the pressing pad measured along the feeding direction.

Further features of the present invention will become apparent from the following description of exemplary embodiments with reference to the attached drawings.

Figure 4:
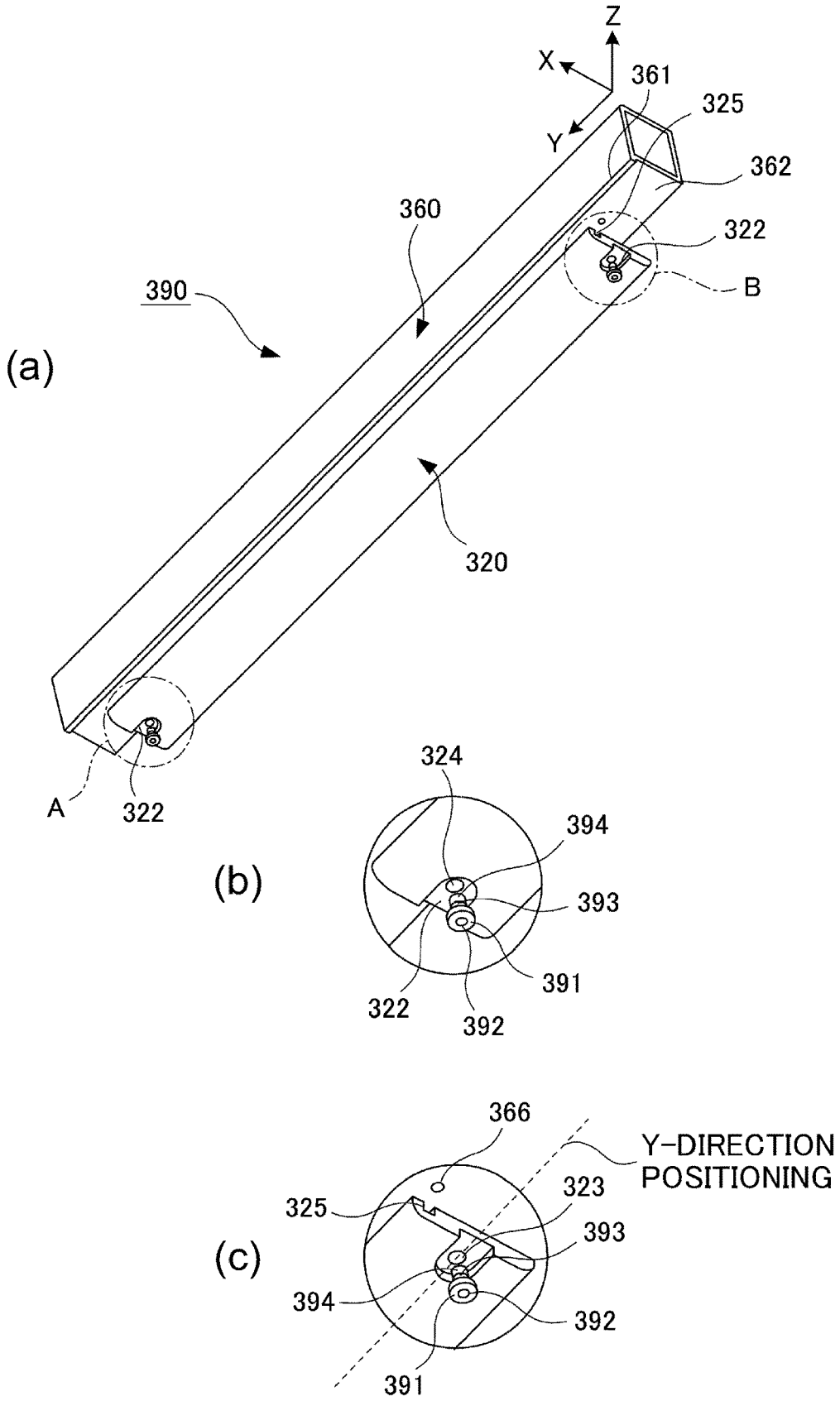

Part (a) of FIG. 4 is an exploded perspective view of a fixing pad unit in the first embodiment, part (b) of FIG. 4 is an enlarged view of a portion A of part (a) of FIG. 4, and part (c) of FIG. 4 is an enlarged view of a portion B of part (a) of FIG. 4.

Figure 5:
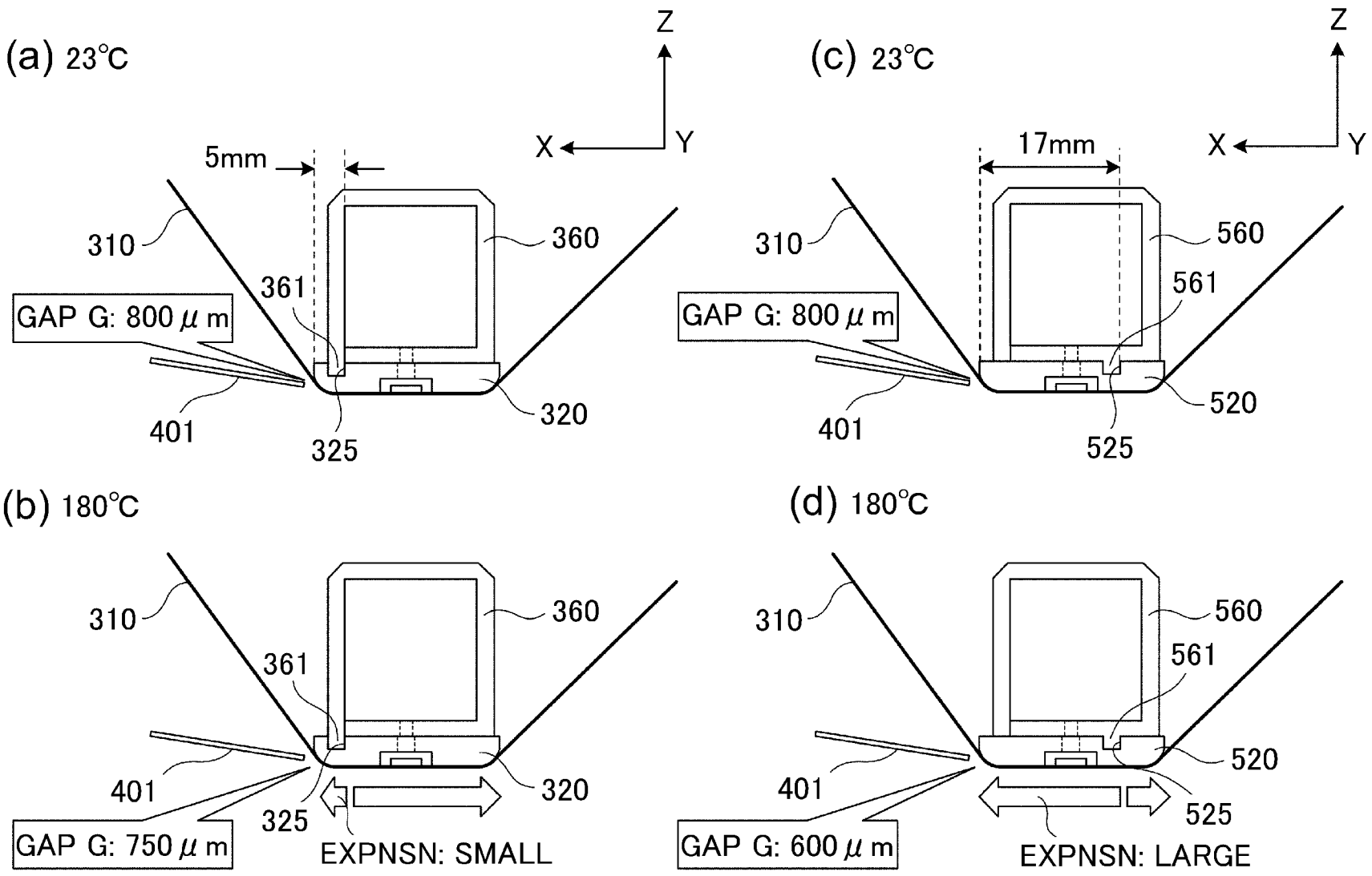

Parts (a) and (b) of FIG. 5 are sectional views of the fixing pad unit and a periphery thereof in the first embodiment, in which part (a) shows a state before thermal expansion and part (b) shows a state after the thermal expansion.

Parts (c) and (d) of FIG. 5 are sectional views of a fixing pad unit and a periphery thereof in a comparison example, in which part (c) shows a state before thermal expansion and part (d) shows a state after the thermal expansion.

Figure 6:
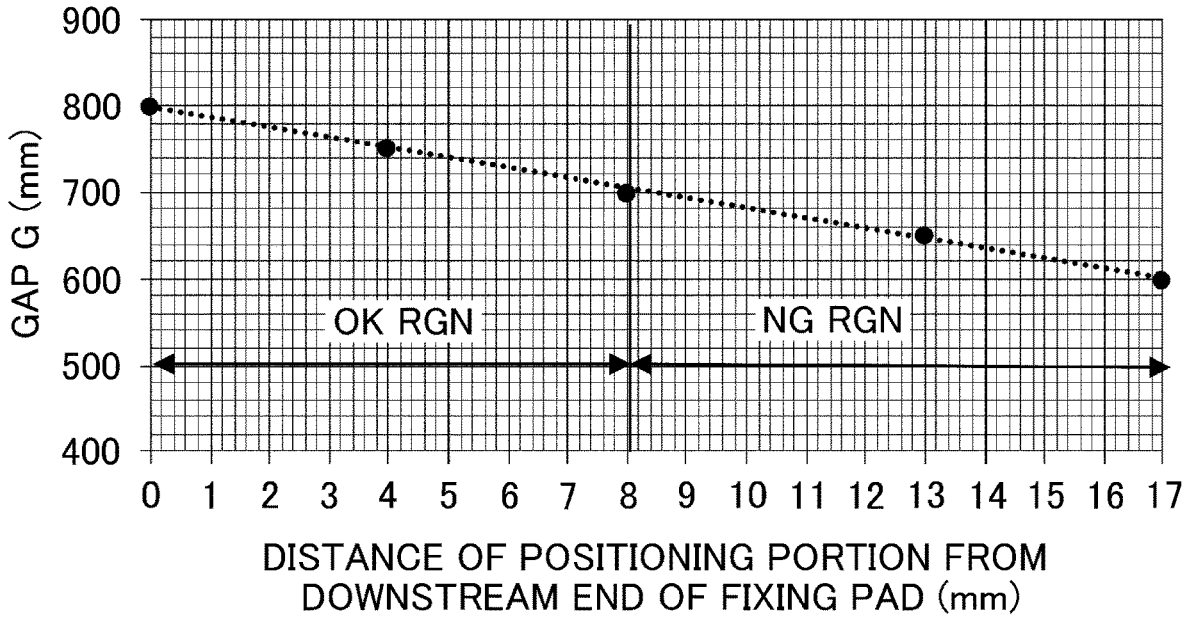

FIG. 6 is a graph showing a relationship between a gap and a distance of a positioning portion from a downstream end of a fixing pad.

Figure 7:
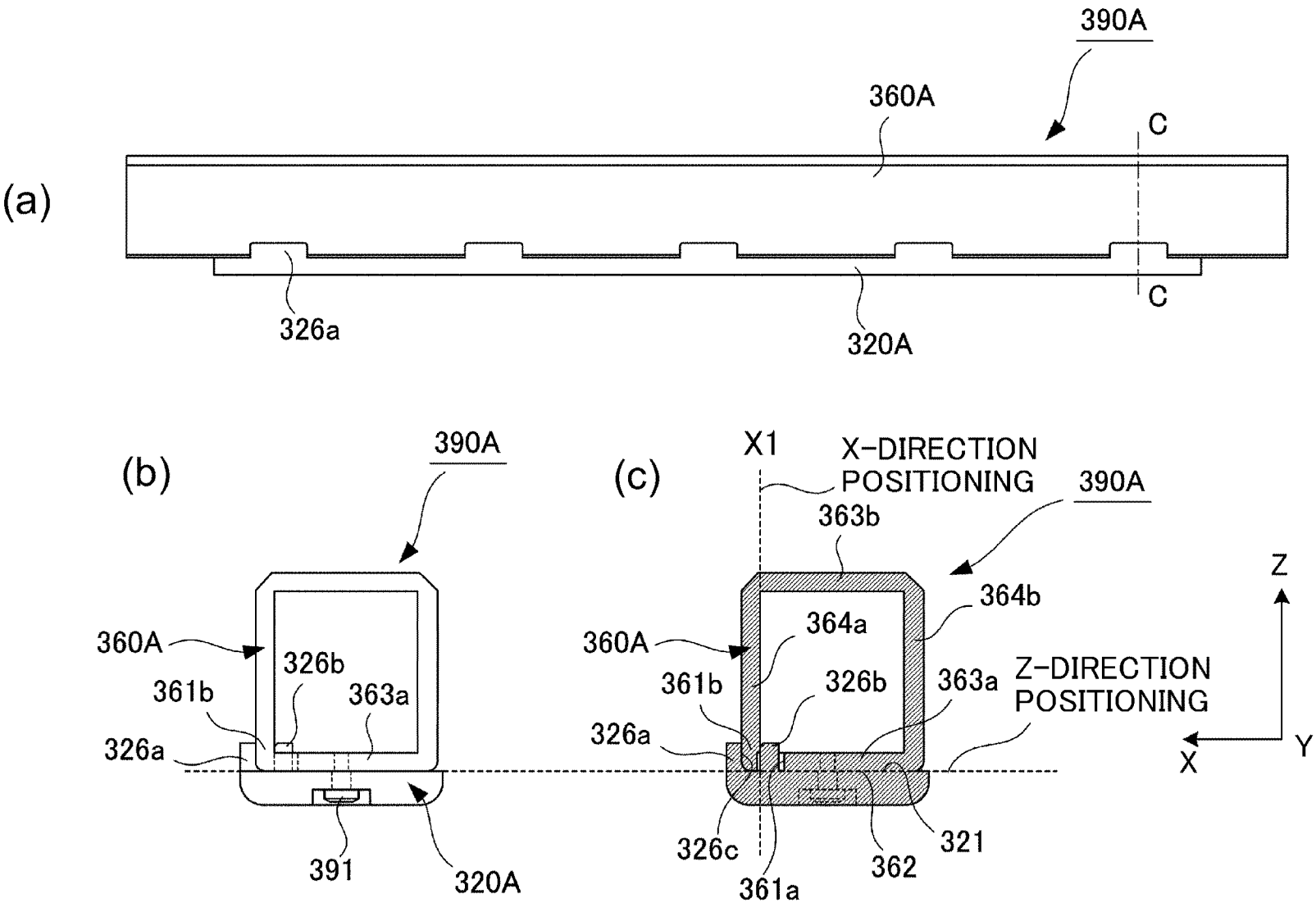

Part (a) of FIG. 7 is a side view of a fixing pad unit in a second embodiment, part (b) of FIG. 7 is a side view of the fixing pad unit of part (a) of FIG. 7 as seen from a right-hand side, and part (c) of FIG. 7 is a sectional view of the fixing pad unit taken along a C-C line of part (a) of FIG. 7.

Figure 8:
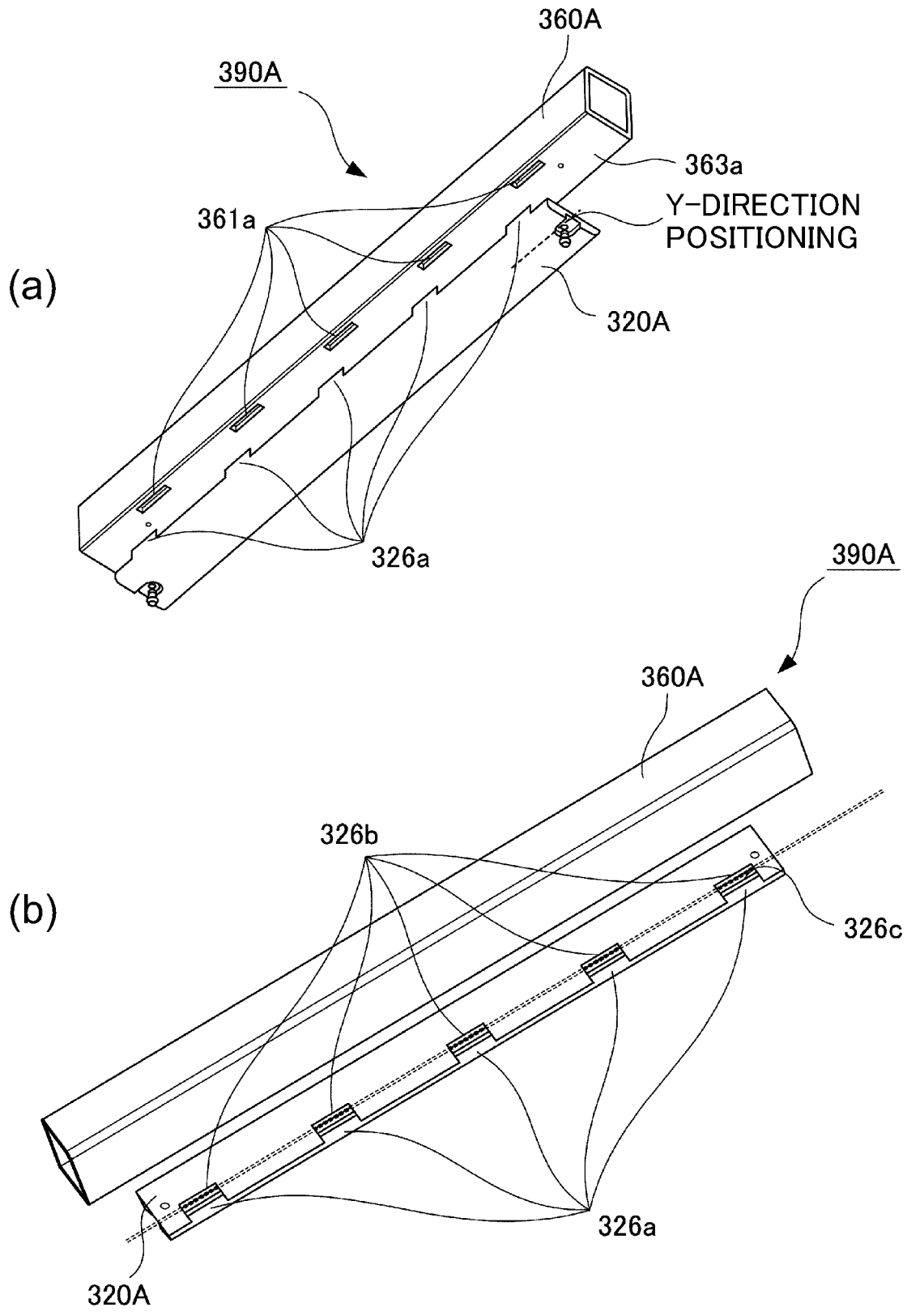

Part (a) of FIG. 8 is an exploded perspective view of the fixing pad unit in the second embodiment as seen from a fixing pad side, and part (b) of FIG. 8 is an exploded perspective view of the fixing pad unit in the second embodiment as seen from a stay side.

Figure 9:
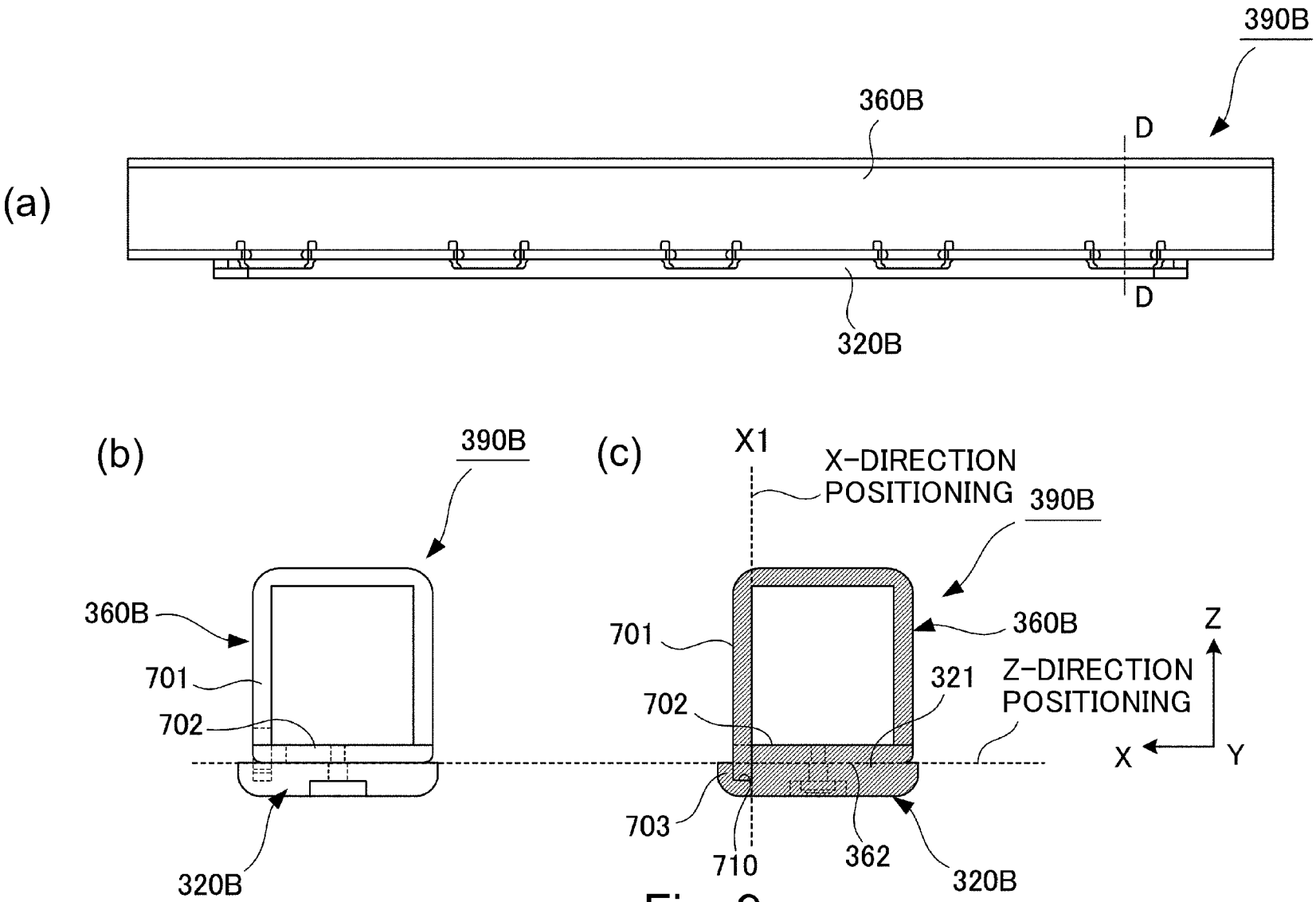

Part (a) of FIG. 9 is a side view of a fixing pad unit in a third embodiment, part (b) of FIG. 9 is a side view of the fixing pad unit of part (a) of FIG. 9 as seen from a right-hand side, and part (c) of FIG. 9 is a sectional view of the fixing pad unit taken along a D-D line of part (a) of FIG. 9.

Figure 10:
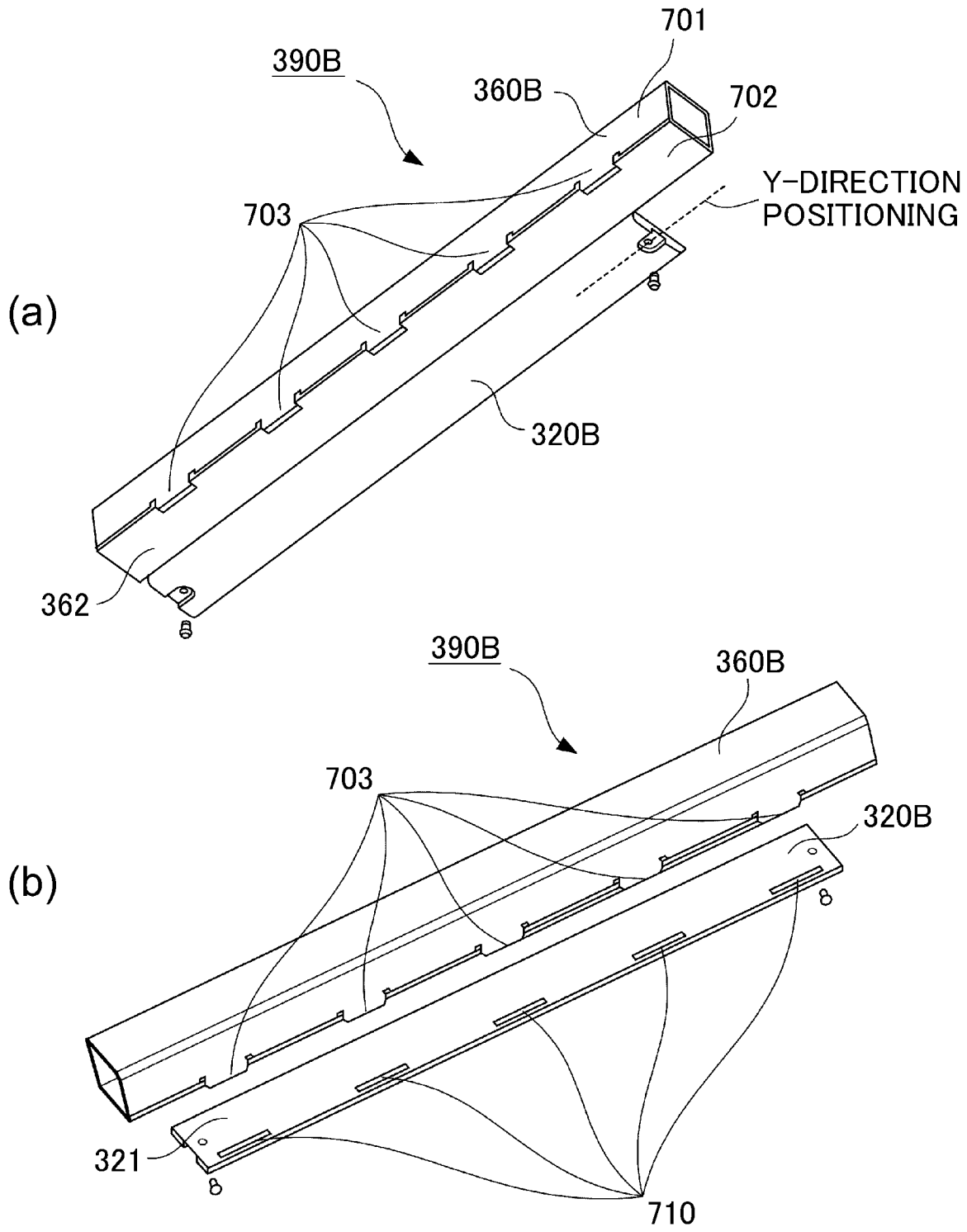

Part (a) of FIG. 10 is an exploded perspective view of the fixing pad unit in the third embodiment as seen from a fixing pad side, and part (b) of FIG. 10 is an exploded perspective view of the fixing pad unit in the third embodiment as seen from a stay side.

DESCRIPTION OF THE EMBODIMENTS

First Embodiment

A first embodiment of the present invention will be described using FIGS. 1 to 7. First, a general structure of the image forming apparatus according to this embodiment will be described using FIG. 1.

[Image Forming Apparatus]

An image forming apparatus 1 is an electrophotographic full-color printer including four image forming portions Pa, Pb, Pc and Pd provided correspondingly to four colors of yellow, magenta, cyan and black. In this embodiment, the image forming apparatus 1 is of a tandem type in which the image forming portions Pa, Pb, Pc and Pd are disposed along a rotational direction of an intermediary transfer belt 204 described later. In this embodiment, the image forming apparatus 1 forms, on a recording material, a toner image (image) depending on an image signal from a host device, such as a personal computer, communicatably connected to an image forming apparatus main assembly 3 or an image reading portion (original reading device) 2 connected to the image forming apparatus main assembly 3. As the recording material, it is possible to cite a sheet material such as a sheet, a plastic film or a cloth.

The image forming apparatus 1 includes the image reading portion 2 and the image forming apparatus main assembly 3. The image reading portion reads an original placed on an original supporting platen glass 21, and light emitted from a light source 22 is reflected by the original and is formed in an image on a CCD sensor 24 through an optical system member 23 such as a lens. Such an optical system unit converts the original into an electric signal data stream (string) for each of lines by scanning the original with the light in an arrow direction. An image signal obtained by the CCD sensor 24 is sent to the image forming apparatus main assembly 3, and then subjected to image processing for an associated one of the image forming portions by a controller 30 as described later. Further, the controller 30 also receives external input as the image signal from an external host device such as a print server.

The image forming apparatus main assembly 3 include a plurality of image forming portions Pa, Pb, Pc and Pd, and in each of the image forming portions, image formation is carried out on the basis of the above-described image signal. That is, the image signal is converted into a laser beam subjected to PWM (pulse width modulation) control by the controller 30. A polygon scanner 31 as an exposure device scans each of photosensitive drum surfaces with the laser beam. Thus, photosensitive drums 200*a* to 200*d* as image bearing members of the respective image forming portions Pa to Pd are irradiated with the laser beams.

Incidentally Pa is the image forming portion for yellow (Y), Pb is the image forming portion for magenta (M), Pc is the image forming portion for cyan (C) and Pd is the image forming portion for black (Bk), and these portions form images of associated colors. The image forming portions Pa to Pd have the substantially same structure, and therefore, in the following, the image forming portion Pa for Y is described in detail and other image forming portions will be omitted from description. In the image forming portion Pa, on the surface of the photosensitive drum 200*a*, a toner image is formed on the basis of the image signal as described below.

A charging roller 201*a* as a primary charger electrically charges the surface of the photosensitive drum 200*a* to a predetermined potential to prepare for electrostatic latent image formation. An electrostatic latent image is formed on the surface of the photosensitive drum 200*a* charged to the predetermined potential, by irradiation with the laser beam from the polygon scanner 31. A developing device 202*a* develops the electrostatic latent image on the photosensitive drum 200*a*, so that the toner image is formed. A primary transfer roller 203*a* transfers the toner image from the photosensitive drum 200*a* onto the intermediary transfer belt 204 under application of a primary transfer bias of an opposite polarity to a charge polarity of toner by electrically discharging the intermediary transfer belt 204 from a back surface (side). The surface of the photosensitive drum 200*a* after the transfer is cleaned by a cleaner 207*a*.

Further, the toner image on the intermediary transfer belt 204 is fed to a subsequent image forming portion, so that in the order of Y, M, C and Bk, the respective color toner images successively formed in the associated image forming portions are transferred, and thus the four color toner images are formed on the surface of the intermediary transfer belt 204. Then, the toner images passed through the image forming portion Pd for Bk positioned on a most downstream side with respect to a rotational direction of the intermediary transfer belt 204 are fed to a secondary transfer portion constituted by a secondary transfer roller pair 205 and 206. Then, in the secondary transfer portion, the toner images are secondary-transferred from the intermediary transfer belt 204 onto the recording material under application of a secondary transfer electric field of an opposite polarity to the charge polarity of the toner images.

The recording material is accommodated in a cassette 9, and the recording material fed from the cassette 9 is fed to a registration portion 208 constituted by, for example, a pair of registration rollers and awaits at the registration portion 208. Thereafter, the registration portion 208 is subjected to timing control for aligning the toner images on the intermediary transfer belt 204 with the sheet (recording material), and then the recording material is fed to the secondary transfer portion.

The recording material on which the toner images are transferred at the secondary transfer portion is fed to a fixing device 8, in which the toner images are heated and pressed, so that the toner images carried on the recording material are fixed on the recording material. The recording material passed through the fixing device 8 is discharged onto a discharge tray 7. Incidentally, in the case where images are formed on double surfaces (sides) of the recording material, when transfer and fixation of the toner image onto a first surface (front surface) of the recording material are ended, the recording material is turned upside down by being fed through a reverse feeding portion 10, and transfer and fixation of the toner image onto a second surface (back surface) of the recording material are carried out, so that the recording material is stacked on the discharge tray 7.

Incidentally, the controller 30 carries out control of entirety of the image forming apparatus 1 as described above. Further, the controller 30 is capable of making various settings on the basis of input from an operating portion 4 of the image forming apparatus 1. Such a controller 30 includes a CPU (Central Processing Unit), a ROM (Read Only Memory) and a RAM (Random Access Memory). The CPU carries out control of respective portions while reading programs which are stored in the ROM and which correspond to control procedures. Further, in the RAM, operation data and input data are stored, and the CPU carries out the control by making reference to the data stored in the RAM, on the basis of the above-described programs or the like.

[Fixing Device]

Figure 1:
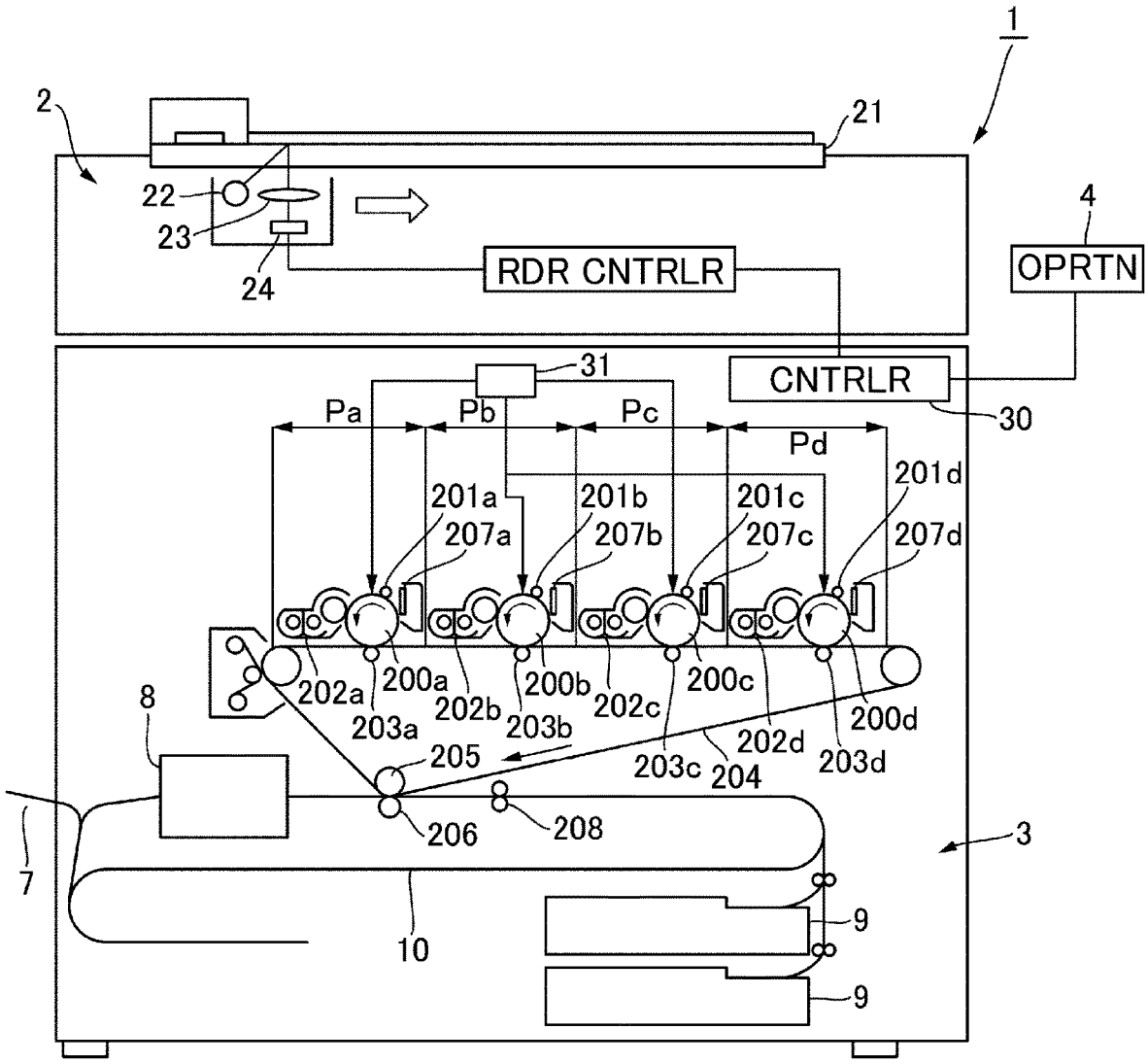
FIG. 1 is a schematic sectional view of an image forming apparatus in a first embodiment.
Figure 2:
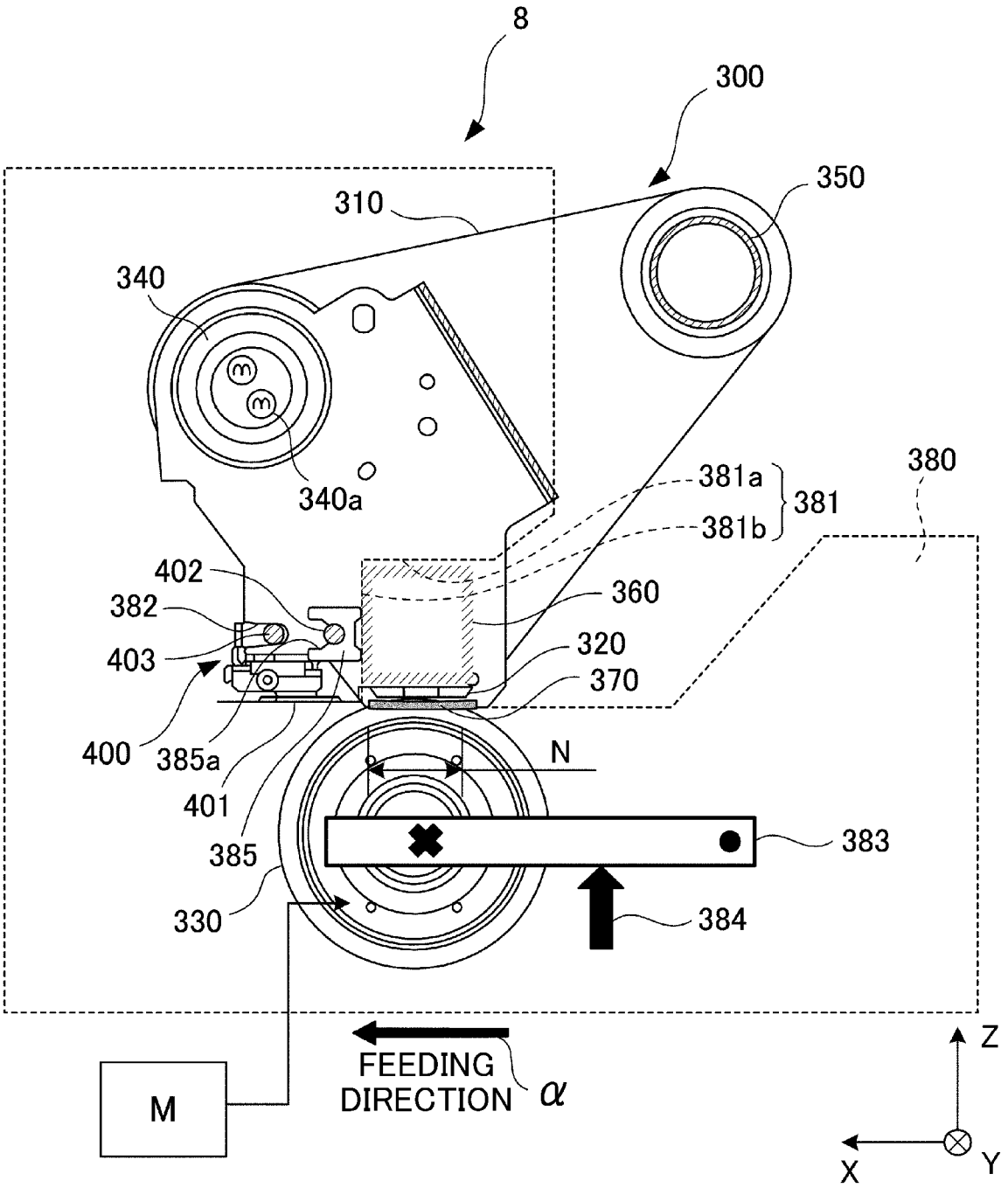
FIG. 2 is a schematic sectional view of a fixing device according to the first embodiment.

Next, a structure of the fixing device 8 in this embodiment will be described using FIG. 2. In this embodiment, a fixing device of a belt heating type using an endless belt is employed. In FIG. 2, the recording material is fed from a right to left direction as shown by an arrow a. The fixing device 8 includes a heating unit 300 including a fixing belt as an endless and rotatable belt and a pressing roller 330 as a rotatable pressing member, contacting the fixing belt 310, for forming a nip in cooperation with the fixing belt 310.

The heating unit 300 includes the above-described fixing belt 310, a fixing pad 320 as a nip forming member and a pad member, a heating roller 340 as a stretching roller, and a steering roller 350. The pressing roller 330 rotates in contact with an outer peripheral surface of the fixing belt 310 and is also rotatable driving member for imparting a driving force to the fixing belt 310.

The fixing belt 310 which is an endless belt has a heat conductive property, a heat resistant property and the like, and has a thin cylindrical shape with an inner diameter of 120 mm, for example. In this embodiment, the fixing belt 310 has a three-layers structure consisting of a base layer, an elastic layer formed on an outer peripheral surface of the base layer, and a parting layer formed on an outer peripheral surface of the elastic layer. The base layer is 60 μm in thickness and a polyimide (PI) resin material is used. The elastic layer is 30 μm in thickness and a silicone rubber material is used. The parting layer is 300 μm in thickness and PFA (polytetrafluoroethylene-perfluoroalkoxyethylene copolymer) resin material is used. Such a fixing belt 310 is stretched by the fixing pad 320, the heating roller 340 and the steering roller 350.

The fixing pad 320 as the nip forming member is not only disposed inside the fixing belt 310 so as to oppose the pressing roller 330 through the fixing belt 310, but also forms a nip N in which the recording material is nipped and fed between the fixing belt 310 and the pressing roller 330. In this embodiment, the fixing pad 320 is a substantially plate-like member long along a widthwise direction (a longitudinal direction crossing the rotational direction of the fixing belt 310, rotational axis direction of the heating roller 340) of the fixing belt 310. The fixing pad 320 is pressed against the fixing belt 310 toward the pressing roller 330, so that the nip N is formed. As a material of the fixing pad 320, an LCP (liquid crystal polymer) is used.

The fixing pad 320 is formed in a flat surface shape at least in a part of a portion thereof for forming the nip. That is, a portion thereof contacting a lubrication sheet 370 described later toward an inner peripheral surface of the fixing belt 310 is formed in a substantially flat surface shape, so that a shape of the nip becomes a substantially flat shape. By employing such a constitution, particularly in the case where the toner image is fixed on an envelope as the recording material, it is possible to suppress that a crease or an image deviation occurs on the envelope.

The fixing pad 320 is supported by a stay 360 as a supporting member provided inside the fixing belt 310. That is, the stay 360 is disposed on a side opposite from the pressing roller 330 with respect to the fixing pad 320 and supports the fixing pad 320. Such a stay 360 is a reinforcing member which is long along the longitudinal direction of the fixing belt 310 and which has rigidity. The stay 360 contacts the fixing pad 320 and supports the fixing pad 320. That is, the stay 360 imparts strength to the fixing pad 320 and ensures a pressing force in the nip N when the fixing pad 320 is pressed by the pressing roller 330.

The stay 360 is made of metal such as a stainless steel, and a cross-section thereof perpendicular to the longitudinal direction of the stay 360 which crosses the rotational direction of the fixing belt 310 has a substantially rectangular shape. For example, the stay 360 is formed with a 3 mm-thick drawing material of SUS 304 (stainless steel), and the cross-section thereof is formed in a substantially square-shaped hallow portion, so that strength is ensured. Incidentally, the stay 360 may also formed in a substantially rectangular shape in cross-section by combining a plurality of metal plates and then by fixing the plates to each other through welding or the like. Further, the material of the stay 360 is not limited to the stainless steel when strength required is ensured.

Figure 3:
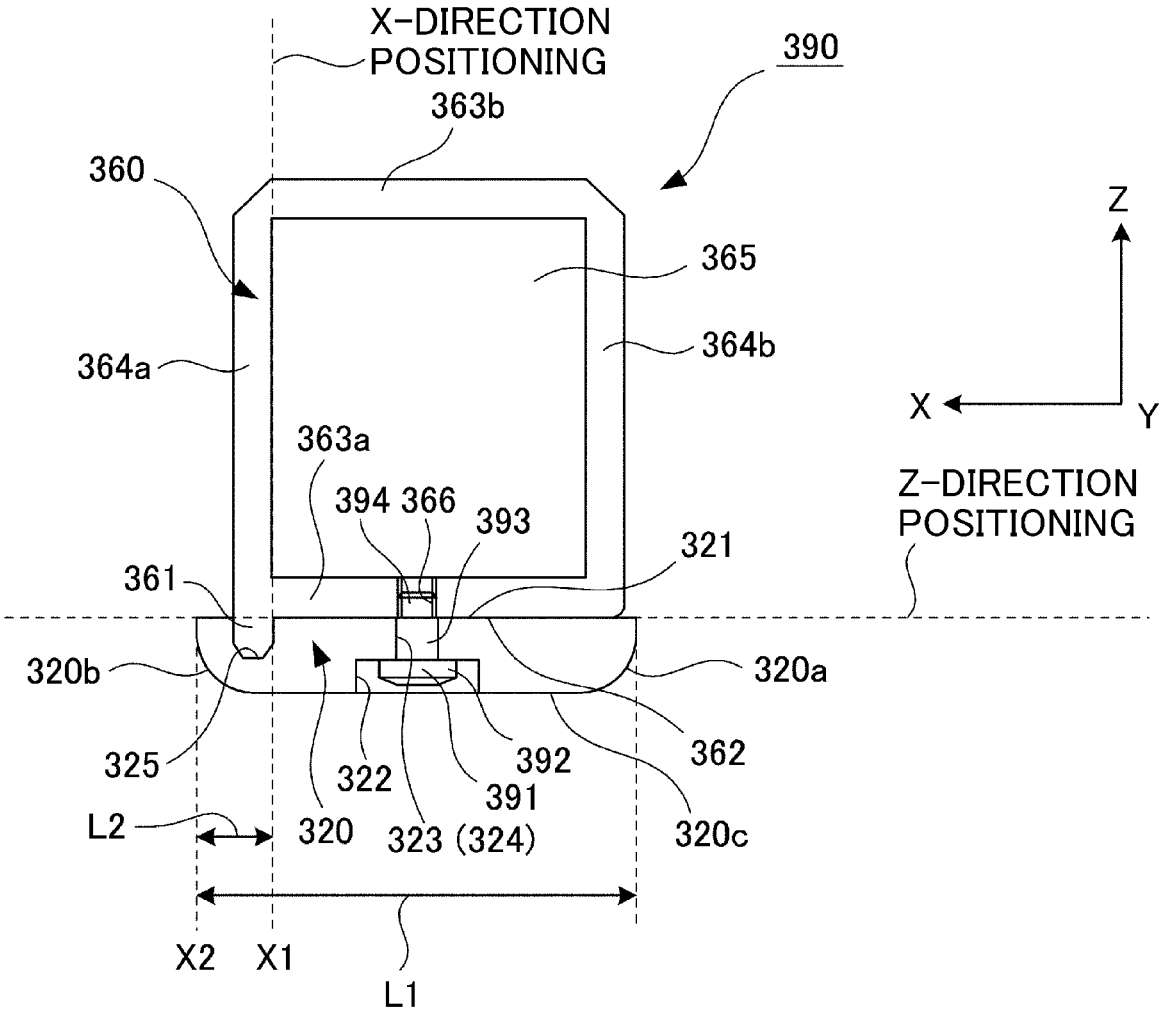
FIG. 3 is a sectional view of a fixing pad unit in the first embodiment.

Further, as shown in FIG. 3, opposite end portions of the fixing pad 320 with respect to the recording material feeding direction in the nip N are curved surface shape portions 310*a* and 320*b*, respectively. Each of the curved surface shape portions 320*a* and 320*b* has a curved surface curved from a nip surface toward the end portion in a direction (upward in FIG. 3) of moving away from the nip surface. The nip surface is a surface along a surface (lower surface of FIG. 3) of the fixing pad 320 on the pressing roller 330 side.

Thus, in this embodiment, the downstream end portion of the fixing pad 320 is the curved surface shape portion 320*b*, and the fixing belt 310 is curved by the curvature of the curved surface shape portion 320*b*. Further, the recording material passed through the nip N is separated from the fixing belt 310 by the curvature of the fixing belt 310.

Between the fixing pad 320 and the fixing belt 310, a lubrication sheet 370 is interposed. In this embodiment, as the lubrication sheet 370, a PI (polyimide) sheet coated with PTFE (polytetrafluoroethylene) is used, and a thickness thereof is 100 μm. The PI sheet is provided with projections of 100 μm formed with an interval of 1 mm, so that a contact area with the fixing belt 310 is reduced and thus a sliding resistance is decreased.

Further, onto an inner peripheral surface of the fixing belt 310, a lubricant is applied, so that the fixing belt 310 smoothly slides on the lubrication sheet 370 covering the fixing pad 320. As the lubricant, silicone oil of 100 cSt in viscosity is used.

As shown in FIG. 2, the heating roller 340 is disposed inside the fixing belt 310 and stretches the fixing belt 310 in cooperation with the fixing pad 320, and imparts a driving force to the fixing belt 310. The heating roller 340 is formed of metal such as aluminum or stainless steel in a cylindrical shape, and in which a halogen heater 340*a* as a heating source for heating the fixing belt 310 is provided. Further, the heating roller 340 is heated up to a predetermined temperature by the halogen heater 340*a*.

In this embodiment, from a viewpoint of thermal conductivity, the heating roller 340 is formed with, for example, an aluminum pipe of 40 mm in outer diameter and 1 mm in thickness, and a surface layer thereof is subjected to anodization (alumite) treatment. Further, the halogen heater 340*a* may also be a single heater, but when temperature distribution of the heating roller 340 with respect to a longitudinal direction (rotational axis direction) is taken into consideration, a plurality of halogen heaters 340*a* may desirably be used. The halogen heaters 340*a* provided in plurality have light distribution different from each other with respect to the longitudinal direction, and a lighting ratio is controlled depending on a size of the recording material. In this embodiment, two halogen heaters 340*a* are disposed. Incidentally, the heating source is not limited to the halogen heater, but may also be another heater, such as a carbon heater, capable of heating the heating roller 340.

The fixing belt 310 is heated by the heating roller 340 heated by the halogen heater 340*a* and is controlled at a predetermined target temperature depending on a kind of the recording material, on the basis of temperature detection by an unshown thermistor.

The steering roller 350 is disposed inside the fixing belt 310 and stretches the fixing belt 310 in cooperation with the fixing device 320 and the heating roller 340, and is rotated by the fixing belt 310. The steering roller 350 is tilted relative to a rotational axis direction (longitudinal direction) of the heating roller 340, and thus controls a position (shift position) of the fixing belt 310 with respect to this rotational axis direction. That is, the steering roller 350 includes a rotation center in the center of the steering roller 350 with respect to the rotational axis direction (longitudinal direction) and swings about this rotation center, so that the steering roller 350 tilts with respect to the longitudinal direction of the heating roller 340. By this, a difference in tension is generated between one side and the other side of the fixing belt 310 with respect to the longitudinal direction, so that the fixing belt 310 is moved in the longitudinal direction.

The fixing belt 310 shifts to either one of opposite end portions thereof during rotation due to outer diameter accuracy of the roller for stretching the fixing belt 310 and alignment accuracy between the respective rollers. For this reason, the shift of the fixing belt 310 is controlled by the steering roller 350. Incidentally, the steering roller 350 may also be swung by a driving source such as a motor, or a constitution in which the fixing belt 310 is swung by self-alignment may also be employed. Further, the rotation center may be the center of the steering roller 350 with respect to the longitudinal direction as in this embodiment and may also be an end portion of the steering roller 350 with respect to the longitudinal direction.

Further, in the case of this embodiment, the steering roller 350 is also tension roller which is urged by a spring supported by a frame of the heating unit 300 and which imparts predetermined tension to the fixing belt 310. The tension is applied to the fixing belt 310 by the steering roller 350 as described above, so that the fixing belt 310 is caused to follow the curved surface shape portions 320*a* and 320*b* of the fixing pad 320. That is, the fixing belt 310 is curved along the curved surface shape portions 320*a* and 320*b*.

Further, the steering roller 350 is formed in a cylindrical shape by metal such as aluminum or stainless steel. In this embodiment, the steering roller 350 is a pipe which is 40 mm in outer diameter and 1 mm in thickness and which is made of stainless steel or aluminum, and opposite end portions thereof are rotation-supported by unshown bearings.

The pressing roller 330 as a rotatable driving member rotates in contact with the outer peripheral surface of the fixing belt 310 and imparts a driving force to the fixing belt 310. In this embodiment, the pressing roller 330 is a roller prepared by forming an elastic layer on an outer peripheral surface of a shaft and then by forming a parting layer on an outer peripheral surface of the elastic layer. The shaft is formed of stainless steel. The elastic layer is formed in a thickness of 5 mm with an electroconductive silicone rubber. The parting layer is formed in a thickness of 50 μm with PFA (tetrafluoroethylene-perfluoroalkoxyethylene copolymer) as a fluorine-containing resin material. The pressing roller 330 is supported by a fixing frame 380 of the fixing device 8 so as to be rotatable, and to one end portion thereof, a gear is fixed. The pressing roller 330 is connected to a motor M as a pressing roller driving source and is rotationally driven.

The fixing frame 380 is provided with a heating unit positioning portion 381, a pressing frame 383 and a pressing spring 384. The heating unit 300 is positioned to the fixing frame 380 by inserting the stay 360 into the heating unit positioning portion 381 and then by fixing the stay 360 to the heating unit positioning portion 381 with unshown fixing means. Here, the heating unit positioning portion 381 includes a pressing direction restricting surface 381*a* opposing the pressing roller 330 and includes a feeding direction restricting surface 381*b* which is an abutting surface with respect to an inserting direction of the heating unit 300. The stay 360 is fixed in a state in which movement thereof is restricted by the pressing direction restricting surface 381*a* and the feeding direction restricting surface 381*b*. At this time, the pressing roller 330 is spaced from the fixing belt 310.

The pressing roller 330 is contacted to the fixing belt 310 by moving the pressing frame 383 by an unshown driving source and a cam after the heating unit 300 is positioned to the heating unit positioning portion 381. Then, the pressing roller 330 is pressed against the fixing belt 310 toward the fixing pad 320. That is, in this embodiment, the pressing roller 330 is also a pressing member pressed toward the fixing belt 310. In this embodiment, a pressing force (pressure) during image formation is 1000 N, for example.

Further, in the case of this embodiment, a separation device 400 including a separating member (separation plate in this embodiment) 401 for separating the recording material from the fixing belt 310 is provided on a side downstream of the nip N with respect to the recording material feeding direction. The separating member 401 is disposed with a gap from the outer peripheral surface of the fixing belt 310 and separates the recording material, passed through the fixing nip N, from the fixing belt 310. Specifically, the separating member 401 is disposed close to a portion of the outer peripheral surface of the fixing belt 310 stretched between the fixing pad 320 and the heating roller 340. Further, the separating member 401 is formed in a blade shape, and a free end thereof is opposed to the outer peripheral surface of the fixing belt 310. Further, the separating member 401 is formed with a metal plate onto which a tape of a fluorine-containing resin material is applied for preventing toner deposition and image scars, and the like on the recording material due to sliding therebetween. In this embodiment, in order to dispose the separating member 401 with the gap from the outer peripheral surface of the fixing belt 310, the separating member 401 is positioned relative to the stay 360 with respect to the recording material feeding direction (short-side direction of the stay 360, X-direction).

That is, the separation device 400 includes the separating member 401, a first projected portion 402 and a second projected portion 403. Such a separation device 400 is positioned to and supported by the stay 360 and the fixing frame 380. That is, the stay 360 is provided with a separating member positioning portion 385, and the separating member positioning portion 385 is provided with a first engaging groove 385*a* formed along the recording material feeding direction (X-direction). On the other hand, the fixing frame 380 is provided with a second engaging groove 382 formed along the X-direction.

In the case where the separation device 400 is supported by the stay 360 and the fixing frame 380, the separation device 400 is moved along the X-direction while the first projected portion 402 and the second projected portion 403 are caused to enter the first engaging groove 385*a* and the second engaging groove 382, respectively. Then, positioning of the separation device 400 with respect to the X-direction is made in a state in which the first projected portion 402 is engaged with the first engaging groove 385*a*. On the other hand, positioning of the separation device 400 with respect to a rotational direction about the engaging portion between the first projected portion 402 and the first engaging portion 385*a* is made in a state in which the second projected portion 403 is engaged with the second engaging groove 382. By this, the separation device 400 is positioned relative to the stay 360 and the fixing frame 380 with respect to the X-direction and the rotational direction. Further, the first projected portion 402 and the second projected portion 403 are retained by unshown retaining members, whereby the separation device 400 is supported by the stay 360 and the fixing frame 380.

Thus, in this embodiment, the separating member 401 is positioned with respect to the X-direction by engaging the first projected portion 402 of the separation device 400 with the first engaging groove 385*a* of the stay 360. In other words, the separating member 401 is positioned relative to the stay 360 with respect to the recording material feeding direction. Incidentally, the separating member 401 may also be positioned relative to a member, for example the fixing frame 380, other than the fixing pad 320 with respect to the X-direction.

The thus-constituted fixing device 8 heats the toner image while nipping and feeding the toner image-carrying recording material in the nip N formed between the fixing belt 310 and the pressing roller 330. By this, the toner image is melted and is fixed on the recording material. In the case of this embodiment, during image formation, a peripheral speed of the fixing belt 310 is 300 mm/s, a pressing force in the nip N is 10000 N, and a temperature of the fixing belt is 180° C.

[Fixing Pad Unit]

Next, a fixing pad unit 390 including the fixing pad 320 and the stay 360 will be described using FIG. 3 and parts (a) to (c) of FIG. 4. FIG. 3 is a sectional view of the fixing pad unit 390 cut along a direction perpendicular to the longitudinal direction in the neighborhood of an end portion of the fixing pad unit 390, and part (a) of FIG. 4 is an exploded perspective view of the fixing pad unit 390 as seen from the fixing pad 320 side. The fixing pad unit 390 is constituted by fixing the fixing pad 320 and the stay 360 with stepped screws 391.

The fixing pad 320 includes a surface on a side where the nip N is formed, i.e., a surface opposing the pressing roller 330 through the fixing belt 310, which surface is constituted by the curved surface shape portions 320*a* and 320*b* and a flat surface (portion) 320*c*. The curved surface shape portions 320*a* and 320*b* are provided so as to be continuous to opposite sides of the flat surface 320*c* with respect to the recording material feeding direction. Further, the flat surface 320*c* forms a nip surface in the nip N, i.e., a surface substantially parallel to the recording material feeding direction. The curved surface shape portions 320*a* and 320*b* are as described above.

On the other hand, a surface of the fixing pad 320 on a side opposite from the nip N, i.e., a surface opposing the stay 360 is an opposing surface 321 which is a flat surface substantially parallel to the flat surface 320*c*. Further, this opposing surface 321 is a surface-to-be-supported by the stay 360 as described later specifically. Further, the opposing surface 321 is provided with a recessed portion 325 engageable with a projected portion 361 of the stay 360 described later.

Further, as shown in part (a) of FIG. 4, at a portion which is each of opposite end portions of the flat surface 320*c* of the fixing pad 320 with respect to the longitudinal direction and which is a central portion with respect to a widthwise direction along the rotational direction of the fixing belt 310, a recessed portion 322 cut away from an edge (end) of the fixing pad 320 is formed. Further, as shown in part (b) of FIG. 4, in the recessed portion 322 on one side with respect to the longitudinal direction, a circular insertion hole 324 penetrating through the opposing surface 321 is formed. Further, as shown in part (c) of FIG. 4, in the recessed portion 322 on the other side with respect to the longitudinal direction, an elongated hole 323 penetrating through the opposing surface 321 is formed.

The stay 360 is formed in the rectangular shape as described above, and as shown in FIG. 3, includes a pair of flat plate portions 363*a* and 363*b* and side plate portions 364*a* and 364*b* each connecting these flat plate portions 363*a* and 363*b*. Further, a space 365 defined by the flat plate portions 363*a* and 363*b* and the side plate portions 364*a* and 364*b* constitutes a hollow-shaped member extending in the longitudinal direction.

Further, the stay 360 includes the projected portion 361 as a positioning portion which opposes the fixing pad 320 and which projects toward the fixing pad 320 from a bottom 362 supporting the fixing pad 320. The projected portion 361 is formed along the longitudinal direction at a widthwise (short-side) end portion. Specifically, the projected portion 361 is provided at a downstream end portion of the stay 360 with respect to the recording material feeding direction. Further, the projected portion 361 is provided over the entire longitudinal direction. However, the projected portion 361 may also be provided only at a part of the longitudinal direction or may also be provided at a plurality of positions. Incidentally, the recessed portion 325 of the fixing pad 320 engaging with the projected portion 361 is formed in an entire region of the longitudinal direction so as to open at opposite ends thereof with respect to the longitudinal direction. However, in the case where the projected portion 361 is provided only at the part of the longitudinal direction or provided at the plurality of positions, the recessed portion 325 may also be formed so as to conform thereto.

Such a projected portion 361 is formed, in the case where the stay 360 is formed of the drawing material as described above, so as to project from the widthwise end portion of the flat plate portion 363*a* when drawing (process) is carried out. Incidentally, the projected portion 361 may also be formed by machining (cutting). Further, in the case where the stay 360 is formed by combining a plurality of metal plates, for example, a single metal plate is bent so that an end portion of one side plate portion 364*a* is projected from the flat plate portion 363*a*. Thus, this projected portion, i.e., the end portion of this metal plate is used as the projected portion 361.

Further, on each of longitudinal opposite ends of the fixing pad 320-side flat plate portion 363*a* of the stay 360, at the widthwise central portions, a screw hole 366 is formed. A pair of screw holes 366 is formed in positions conforming to the insertion hole 324 and the elongated hole 323, respectively when the fixing pad 320 is assembled with the stay 360.

The stepped screw 391 includes, as shown in FIG. 3 and parts (a) and (b) of FIG. 4, a head (portion) 392, an engaging portion 393 which is circular in cross-section, and a screw portion 394. Such a stepped screw 391 is inserted from each of the insertion hole 324 and the elongated hole 323 of the fixing pad 320, and is screwed and fastened to the screw hole 366 of the stay 360. At this time, the engaging portion 393 of the stepped screw 391 is inserted into each of the insertion hole 324 and the elongated hole 323, and then the screw portion 394 is fastened to the screw hole 366. The head 392 contacts a periphery of each of the insertion hole 324 and the elongated hole 323 of the associated recessed portion 322 of the fixing pad 320.

Specifically, the opposing surface 321 of the fixing pad 320 is contacted to the bottom 362 of the stay 360. At this time, the projected portion 361 of the stay 360 is engaged with the recessed portion 325 of the fixing pad 320. In this state, as described above, the stepped screws 391 are inserted into the insertion hole 324 and the elongated hole 323, respectively, and are fastened to the screw holes 366, respectively. By this, the fixing pad 320 is fixed to the stay 360 with the stepped screws 391 in a state in which the opposing surface 321 contacts the bottom 362. As a result, positioning of the fixing pad 320 relative to the stay 360 with respect to a height direction (Z-direction of FIG. 3 and part (a) of FIG. 4) is carried out. This height direction is also a direction in which the fixing pad 320 is pressed by the pressing roller 330 through the fixing belt 310.

On the other hand, positioning of the fixing pad 320 with respect to the longitudinal direction (Y-direction of FIG. 3 and part (a) of FIG. 4) is carried out in the following manner. That is, the positioning with respect to the Y-direction is carried out by engaging the engaging portion 393 of the stepped screw 391 with the elongated hole 323. The elongated hole 323 is long in the X-direction. For this reason, the engaging portion 393 of the stepped screw 391 is movable in the X-direction relative to the elongated hole 323. On the other hand, the insertion hole 324 is a hole into which the engaging portion 393 of the stepped screw 391 is intended in a state in which movement of the engaging portion 393 is not restricted with respect to both the X-direction and the Y-direction.

In this embodiment, the positioning of the fixing pad 320 relative to the stay 360 with respect to the Y-direction and the Z-direction is carried out as described above, but the positioning thereof with respect to the widthwise direction (X-direction of FIG. 3 and part (a) of FIG. 4) is carried out in the following manner. That is, as described above, the opposing surface 321 of the fixing pad 320 is provided with the recessed portion 325, and the stay 360 is provided with the projected portion 361. Further, when the fixing pad 320 is assembled with the stay 360, the projected portion 361 is engaged with the recessed portion 325. By this, positioning of the fixing pad 320 relative to the stay 360 with respect to the X-direction, i.e., the recording material feeding direction is realized.

Here, the position where the positioning of the fixing pad 320 relative to the stay 360 with respect to the X-direction is carried out is a position where a distance from a downstream end of the fixing pad 320 with respect to the X-direction is 35% or less of a full length of the fixing pad 320 with respect to the X-direction, preferably be 20% or less. As shown in FIG. 3, in this embodiment, positioning for restricting the movement of the fixing pad 320 relative to the stay 360 toward the downstream side of the X-direction is performed in a position X1 where an upstream end of the projected portion 361 with respect to the X-direction contacts the recessed portion 325. That is, the position where the positioning of the fixing pad 320 relative to the stay 360 with respect to the X-direction is performed is X1.

Accordingly, in the case of this embodiment, when with respect to the X-direction, a downstream end position of the fixing pad 320 is X2, a full length of the fixing pad 320 is L1, and a distance between the positions X1 and X2, $L2/L1 \leq 0.35$ (35%) is satisfied. Further, it is preferable that $L2/L1 \leq 0.20$ (20%) is satisfied. Incidentally, when the positioning is carried out within this range, the position where the projected portion 361 is provided may also be not the downstream end portion of the stay 360 with respect to the X-direction.

In this embodiment, the position where the positioning of the fixing pad 320 relative to the stay 360 with respect to the X-direction is performed is the position such that the distance from the downstream end of the fixing pad 320 with respect to the X-direction is 35% or less of the full length of the fixing pad 320 with respect to the X-direction. Specifically, the projected portion 361 is provided at the downstream end portion of the stay 360 with respect to the X-direction and is engaged with the recessed portion 325 of the fixing pad 320, so that the positioning of the fixing pad 320 with respect to the X-direction is realized.

As described above, the separating member 401 disposed closed and opposed to the fixing belt 310 in order to separate the fixing belt 310 from the recording material is positioned relative to the stay 360 with respect to the X-direction. On the other hand, the fixing pad 320 disposed inside the fixing belt 310 is thermally expanded by receiving heat from the heated fixing belt 310. The fixing belt 310 is stretched along the curved shape portion **320*b* positioned at the downstream end portion of the fixing pad 320 and is curved by curvature of the curved shape portion 320*b*. Further, the recording material passed through the nip N is separated from the fixing belt 310 by the curvature of the fixing belt 310. For this reason, when the fixing pad 320 is thermally expanded, a portion of the fixing belt 310 stretched by the curved shape portion 320*b* moves in the X-direction, so that the fixing belt 310 approaches the separating member 401. Thus, there is a liability that the fixing belt 310 contacts the separating member 401 and is damaged by the separating member 401**.

On the other hand, in this embodiment, the position where the fixing pad 320 is positioned relative to the stay 360 is the position where the distance from the downstream end of the fixing pad 320 with respect to the X-direction is 35% or less of the full length of the fixing pad 320 with respect to the X-direction. For this reason, even when the fixing pad 320 is thermally expanded, an amount of thermal expansion of the fixing pad 320 from the positioning portion toward the downstream side with respect to the X-direction can be suppressed. This thermal expansion amount can be more suppressed as the positioning position of the fixing pad 320 with respect to the X-direction is disposed toward the downstream side with respect to the X-direction. For this reason, the position where the positioning of the fixing pad 320 relative to the stay 360 with respect to the X-direction may preferably be the position where the distance from the downstream end of the fixing pad 320 with respect to the X-direction is 20% or less of the full length of the fixing pad 320 with respect to the X-direction.

The positioning position of the fixing pad 320 with respect to the X-direction is set at the above-described position, so that an amount in which the fixing belt 310 approaches the separating member 401 due to the thermal expansion of the fixing pad 320 can be made small. As a result, even when the separating member 401 is disposed close to the fixing belt 310, the separating member 401 can be made hard to contact the fixing belt 310.

The recording material with a small basis weight, such as thin paper is not readily separated from the fixing belt and therefore, in order to enhance a separating property of such a recording material, the separating member 401 may preferably be brought near to the fixing belt 310 to the extent possible. However, as described above, in consideration of the influence of the thermal expansion of the fixing pad 320, it is difficult to bring the separating member 401 sufficiently close to the fixing belt 310. On the other hand, in this embodiment, even when the fixing pad 320 is thermally expanded as described above, the amount in which the fixing belt 310 approaches the separating member 401 can be made small, and therefore, even the recording material small in the basis weight, such as the thin paper can be improved in separating property thereof from the fixing belt 310.

Embodiment

Here, an experiment conducted for confirming an effect of this embodiment will be described using parts (a) to (d) of FIG. 5 and FIG. 6. In this experiment, the fixing device 8 as shown in FIG. 2 was used. Further, electric power of 3000 W was inputted to the halogen heater 340*a* in the heating roller 340, and then the gap G between the fixing belt 310 and the separating member 401 was measured after 2 minutes from temperature control of the fixing belt 310 at 180° C. The gap G was measured by a gap gage in 50 μm intervals.

Further, in the experiment, the fixing pad 320 satisfying the constitution of this embodiment and a fixing pad 520 in a comparison example in which the fixing pad 520 does not satisfy the constitution of this embodiment were prepared and were subjected to the measurement of the gap G. Further, an initial gap G before thermal expansion of each of the fixing pads 320 and 520, i.e., before temperature control was 800 μm in both the embodiment and the comparison example. Parts (a) and (b) of FIG. 5 show states before and after the heating in the embodiment, respectively, and parts (c) and (d) of FIG. 5 show states before and after the heating in the comparison example, respectively.

Incidentally, a stay 560 and the fixing pad 520 in the comparison example are merely different in positioning position from those in the embodiment, and other constitutions thereof are the same as those in the embodiment. For example, the positioning with respect to the Y-direction and the Z-direction is performed in the same manner as in the embodiment. Further, also in the comparison example, the positioning of the fixing pad 520 relative to the stay 560 is performed by engaging a projected portion 561 of the stay 560 with a recessed portion 525 of the fixing pad 520. However, positioning position was a position where the distance from the downstream end of the fixing pad 520 with respect to the X-direction is larger than 35%, specifically 50% or more of the full length of the fixing pad 520 with respect to the X-direction.

Specifically, in the constitution of the embodiment, as shown in part (a) of FIG. 5, the positioning position of the fixing pad 320 with respect to the recording material feeding direction (X-direction) was 5 mm from the downstream end of the fixing pad 320. On the other hand, in the constitution of the comparison example, as shown in part (c) of FIG. 5, the positioning position of the fixing pad 520 with respect to the recording material feeding direction (X-direction) was 17 mm from the downstream end of the fixing pad 520.

Here, each of the fixing pads 320 and 520 was formed of an LCP (liquid crystal polymer) and was $7.1\times10^{-5}$/° C. in linear expansion coefficient. Incidentally, the thermal expansion coefficient was measured by using a sample piece (length: 1 mm, width 1 mm, height: 2 mm) out from the fixing pad and a thermomechanical testing machine ("TM-9000" manufactured by ADVANCE RIKO, Inc.) when the temperature was increased from 20° C. to 200° C. with an increment of 5° C./min.

In the experiment, heating was started from 23° C. and was controlled at 180° C. In this case, the fixing pads 320 and 520 thermally expand about the positioning portions. In the embodiment, the distance from the positioning portion to the downstream end of the fixing pad 320 was 5 mm, and therefore, the thermal expansion amount was about 50 μm. For this reason, as shown in part (b) of FIG. 5, the gap G between the fixing belt 310 and the separating member 401 after the temperature control was about 750 μm.

On the other hand, in the comparison example, the distance from the positioning portion to the downstream end of the fixing pad 520 was 17 mm, and therefore, the thermal expansion amount was about 200 μm. For this reason, as shown in part (d) of FIG. 5, the gap G between the fixing belt 310 and the separating member 401 after the temperature control was about 600 μm. That is, in the embodiment, compared with the comparison example, it was confirmed that a decrease in gap G can be suppressed.

Next, a result of a check of the gap G in the case where the temperature control is carried out similarly as described above while changing the distance of the positioning portion of the associated fixing pad from the downstream end with respect to the X-direction is shown in FIG. 6. As shown in FIG. 6, the gap G became narrower as the distance from the positioning portion to the downstream end of the fixing pad become longer. Incidentally, the fixing pads used in the experiment were about 23 mm in full length with respect to the X-direction.

Here, when the gap G is less than 700 μm due to part accuracy or the like of the separating member 401 and component parts supporting the separating member 401, the distance between the fixing belt 310 and the separating member 401 becomes narrow, so that a risk of contact increases. In the experiment, in the case where the distance from the positioning portion to the downstream end of the fixing pad was 9 mm, the gap G was about 700 μm after the temperature control. Accordingly, when this distance was 8 mm or less, a degree of a liability that the separating member 401 contacts the fixing belt 310 by the influence of the thermal expansion was regarded as small ("OK RGN (region)"). On the other hand, when the distance was larger than 8 mm, there is a liability that the separating member 401 contacts the fixing belt 310 by the influence of the thermal expansion ("NG RGN").

As described above, the full length of the fixing pad is 23 mm, and therefore, when the distance from the downstream end of the fixing pad with respect to the X-direction is 8 mm, a ratio of the distance to the full length of the fixing pad with respect to the X-direction is $8/23=0.347$ (≈35%). Accordingly, from FIG. 6, it is understood that the degree of the liability that the separating member 401 contacts the fixing belt 310 by the influence of the thermal expansion can be decreased by making the ratio 35% or less. Further, it is understood that the gap after the temperature control can be made roughly 750 μm or less by making the ratio 20% or less and by making the distance from the downstream end of the fixing pad with respect to the X-direction 4.6 mm or less and therefore it is preferred.

As described above, in the case of this embodiment, the ratio of the distance from the downstream end of the fixing pad 320 with respect to the X-direction to the full length of the fixing pad 320 is made 35% or less, whereby a degree of the influence of the thermal expansion of the fixing pad 320 can be alleviated. As a result, the risk of the contact between the separating member and the fixing belt is alleviated, so that the gap G between the separating member and the fixing belt is stabilized irrespective of the control temperature and thus a good separation performance can be achieved.

Second Embodiment

A second embodiment will be described using parts (a) to (c) of FIG. 7 and parts (a) and (b) of FIG. 8 while making reference to FIG. 2. This embodiment is different from the first embodiment in constitution of the positioning portion of a fixing pad 320A relative to a stay 360A with respect to the X-direction. Other constitutions and actions are similar to those in the first embodiment and therefore, similar constitutions are represented by the same reference numerals or symbols and are omitted from description and illustration or briefly described. In the following a difference from the first embodiment will be principally described. Incidentally, as regards constituent elements common to the first and second embodiments, reference numerals or symbols will be partially omitted.

A fixing pad unit 390A constituting a fixing device of this embodiment is constituted similarly as in the first embodiment by fixing the fixing pad 320A and the stay 360A with stepped screws 391. The stay 360A is formed in a substantially rectangular shape in cross-section similarly as in the first embodiment and is similar to the stay 360 in the first embodiment except that the projected portion 361 is not provided and that through holes 361*a* are formed. Further, the fixing pad 320A is formed of a resin material similarly as in the first embodiment and is similar to the fixing pad 320 in the first embodiment except that the recessed portion 325 is not provided and that a pair of projected portions 326*a* and 326*b* is provided.

That is, the stay 360A is provided with the through holes 361*a* penetrating in the Z-direction through the flat plate portion 363*a* on the fixing pad 320A side. The through holes 361*a* are formed at the downstream end portion of the flat plate portion 363*a* with respect to the X-direction and are adjacent to a free end portion 361*b* as an engaging portion of a side plate portion 364*a* positioned on the downstream side with respect to the X-direction. Further, the through holes 361*a* are, as shown in part (a) of FIG. 8, provided intermittently in a plurality of positions along the longitudinal direction (Y-direction) of the stay 360A. Incidentally, the through hole 361*a* may also be continuously formed in a single through hole extending in the longitudinal direction. Further, in the case where the stay 360A is formed by bending a metal plate, the through holes 361*a* may also be formed by cutting away a portion of the flat plate portion 363*a* opposing the side plate portion 364*a*.

On the other hand, as shown in part (c) of FIG. 7 and part (a) of FIG. 8, the opposing surface 321 of the fixing pad 320A opposing the stay 360A is provided with the pair of projected portions 326*a* and 326*b* projecting from the opposing surface 321 toward the stay 360A. Each of the projected portions is molded integrally with the fixing pad 320A. Further, the pair of projected portions 326*a* and 326*b* is provided with an engaging groove 326*c* therebetween. The pair of projected portions 326*a* and 326*b* is provided so as to be spaced from each other with respect to the X-direction. The pair of projected portions 326*a* and 326*b* is disposed intermittently in a plurality of positions with respect to the Y-direction. An interval between adjacent pairs of projected portions 326*a* and 326*b* is such that the free end portions 361*a* of the side plate portion 364*a* are engageable with the pair of projected portions 326*a* and 326*b*.

Incidentally, when the through holes 361*a* are continuously formed as a single elongated through hole in the longitudinal direction, the pairs of projected portion 326*a* and 326*b* may also be continuously formed as a single elongated pair of projected portions 326*a* and 326*b* in the longitudinal direction. Further, of the pairs of projected portions 326*a* and 326*b*, the projected portions 326*b* are disposed on the downstream side of the fixing pad 320A with respect to the X-direction.

In such a case of this embodiment, as shown in parts (a) to (c) of FIG. 7, the free end portions 361*b* of the side plate portion 364*a* which are adjacent to each other on the downstream side of the through holes 361*a* are engaged with the engaging grooves 326*c* while inserting the projected portions 326*b* of the fixing pad 320A into the through holes 361*a* of the stay 360A. By this, positioning of the fixing pad 320A relative to the stay 360A with respect to the X-direction, i.e., the recording material feeding direction is realized.

In this embodiment, as shown in part (c) of FIG. 7, positioning for restricting movement of the fixing pad 320A relative to the stay 360A toward the downstream side of the X-direction is performed in the position X1 where downstream end portion of the projected portions 326*b* with respect to the X-direction contact the free end portions 361*b* of the side plate portion 364*a*. Also, in such a case of this embodiment, the free end portions 361*b* which are not only the engaging portions but also the positioning portions are provided at the downstream end portion of the stay 360A with respect to the X-direction. Further, the position where positioning of the fixing pad 320A relative to the stay 360A with respect to the X-direction is carried out is the position where the distance from the downstream end of the fixing pad 320A with respect to the X-direction is 35% or less of the full length of the fixing pad 320A with respect to the X-direction. As in this embodiment, in the case where the projected portions are integrally assembled with the fixing pad through molding with a resin material, the positioning position of the fixing pad may preferably be the position where the above-described distance is 20% or less of the full length of the fixing pad.

Referring to FIG. 8, in this embodiment, the plurality of projected portions 326*a* are provided. Play (backlash) with respect to the X-direction when the longitudinal center projected portion and the associated through hole engage with each other is smallest among play (backlash) when other projected portions and their associated through holes engage with each other. For that reason, in the case where the plurality projected portions and the plurality of through holes engage with each other, the positioning with respect to the X-direction is carried out at the engaging portion where the play (backlash) when the projected portions and the through holes (recessed portions) engage with each other is smallest. For that reason, with respect to the X-direction of this engaging portion, the distance from the downstream end of the fixing pad 320 may only be required to be 35% or less.

Third Embodiment

A third embodiment will be described using parts (a) to (c) of FIG. 9 and parts (a) and (b) of FIG. 10 while making reference to FIG. 2. This embodiment is different from the first embodiment in constitution of the positioning portion of a fixing pad 320B relative to a stay 360B with respect to the X-direction and in constitution of the stay 360B. Other constitutions and actions are similar to those in the first embodiment and therefore, similar constitutions are represented by the same reference numerals or symbols and are omitted from description and illustration or briefly described. In the following a difference from the first embodiment will be principally described. Incidentally, as regards constituent elements common to the first and second embodiments, reference numerals or symbols will be partially omitted.

A fixing pad unit 390B constituting a fixing device of this embodiment is constituted similarly as in the first embodiment by fixing the fixing pad 320B and the stay 360B with stepped screws 391 (omitted from parts (b) and (c) of FIG. 9). The stay 360B is formed in a substantially rectangular shape in cross-section similarly as in the first embodiment, but is formed by welding a bent plate 701 and a flat plate 702, which are metal plates, to each other. Further, a plurality of projected portions 703 are provided along the longitudinal direction of the stay 360B. Other constitutions of the stay 360B are similar to those in the first embodiment. Further, the fixing pad 320B is formed of a resin material similarly as in the first embodiment and is similar to the fixing pad 320 in the first embodiment except that a plurality of recessed portions 710 are formed along the longitudinal direction.

That is, the stay 360B is formed with a 3.2 mm-thick electro-galvanized steel plate as shown in part (c) of FIG. 9, and the bent plate 701 having a substantially U-shape and the flat plate 702 are fixed to each other by welding, so that strength is ensured. Further, as shown in parts (a) and (b) of FIG. 10, the belt plate 701 is provided with a plurality of projected portions 703 as positioning portions with respect to the X-direction.

Specifically, the bent plate 701 is formed by bending a metal plate in the substantially U-shape, and is provided with the projected portions 703 in a plurality of longitudinal positions of an end portion thereof on a downstream side with respect to the X-direction. The flat plate 702 is fixed, by welding, to a side surface of the side plate of the bent plate 701 provided with the projected portions 703 and an end portion of the other side plate of the bent plate 701. A bottom 362 of the flat plate 702 is a supporting surface for supporting the fixing pad 320B. By this, the plurality of projected portions 703 project from the bottom 362 toward the fixing pad 320B.

On the other hand, as shown in part (c) of FIG. 9 and part (b) of FIG. 10, an opposing surface 321, which is a portion-to-be-supported, of the fixing pad 320B supported by the stay 360B is provided with a plurality of recessed portions 710 in positions conforming to the plurality of projected portions 703.

In such a case of this embodiment, as shown in parts (a) to (c) of FIG. 9, the plurality of projected portions 703 of the stay 360B are engaged with the plurality of recessed portions 710 of the fixing pad 320B, respectively. By this, positioning of the fixing pad 320B relative to the stay 360B with respect to the X-direction, i.e., the recording material feeding direction is realized.

Also, in this embodiment, as shown in part (c) of FIG. 9, positioning for restricting movement of the fixing pad 320B relative to the stay 360B toward the downstream side of the X-direction is performed in the position X1 where upstream end portions of the projected portions 703 with respect to the X-direction contact the recessed portions 710. Also, in such a case of this embodiment, the projected portions 703 which are the positioning portions are provided at the downstream end portion of the stay 360B with respect to the X-direction. Further, the position where positioning of the fixing pad 320B relative to the stay 360B with respect to the X-direction is carried out is the position where the distance from the downstream end of the fixing pad 320B with respect to the X-direction is 35% or less, preferably 20% or less, of the full length of the fixing pad 320B with respect to the X-direction.

Other Embodiments

In the above-described embodiments, the constitution in which the heating roller is provided with the halogen heater as the heating source for heating the fixing belt was described. However, the heating source may also be provided in the stretching member such as the steering roller without being provided in the heating roller. Further, the heating source may also be provided in the pad member. For example, a plate-like heating member such as a ceramic heater may also be provided on the fixing belt side of the pad member. Further, a constitution in which the fixing belt is heated through electromagnetic induction heating may also be employed.

Further, in the above-described embodiments, the fixing device in which the fixing belt is stretched by the fixing pad, the heating roller and the steering roller was described. However, the fixing device to which the present invention is applicable is not limited thereto, but for example, a constitution in which the fixing belt is stretched by only a single stretching roller and the fixing pad may also be employed. In summary, it is only required that at least one stretching roller for stretching the fixing belt is provided together with the fixing pad.

Further, in the above-described embodiments, the constitution in which the pressing roller is used as the rotatable driving member was described. However, the rotatable driving member may also be an endless belt which is stretched by a plurality of stretching rollers and which is driven by either one of the stretching rollers. Further, in the above-described embodiments, in order to form the nip, the pressing roller as the rotatable driving member is pressed against the belt, but a constitution in which the belt is pressed against the rotatable driving member may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-228644 filed on Dec. 18, 2019, which is hereby incorporated by reference herein in its entirety.

What is claimed is:

1. A fixing device for fixing a toner image on a recording material, said fixing device comprising:

a rotatable fixing belt;

a heating roller including a heater, wherein said belt is entrained around said heating roller to heat said belt;

a pressing pad of resin material provided inside of said belt;

a rotatable pressing member contacting an outer peripheral surface of said belt and pressing against said pressing pad through said belt to form a nip configured to nip and feed the recording material;

a supporting metal stay supporting said pressing pad and including a plate-like contact surface contacting said pressing pad, wherein one of said pressing pad and said supporting stay is provided with a projection, and the other of them is provided with a recess or hole which is engaged with said projection to determine a position of said pressing pad relative to said supporting stay; and a separation plate provided without contact to said belt at a position opposed to said pressing pad with said belt interposed therebetween and downstream of said nip in a feeding direction of the recording material, wherein a distance measured along a widthwise direction of said pressing pad between an engaging position between said projection and said recess or said hole and a downstream end of said pressing pad in the feeding direction of the recording material is larger than 0% and not larger than 35% of an entire length of said pressing pad measured along the feeding direction.

2. A fixing device according to claim 1, wherein the distance is not larger than 20%.

3. A fixing device according to claim 1, wherein said projection and said recess or said hole portion is provided at each of a plurality of positions arranged in the longitudinal direction of said pressing pad at respective engaging positions, and a distance between a downstream end portion of said pressing pad in the feeding direction of the recording material and the engaging position where play of the engagement is the least is larger than 0% and not larger than 35% of the entire length of the pressing pad measured in the feeding direction.

4. A fixing device according to claim 1, wherein said pressing pad is supported by said supporting stay with a fixing element in an area outside a recording material passing area.

5. A fixing device according to claim 1, wherein said separation plate is made of metal.

6. A fixing device according to claim 1, wherein said supporting stay has a hollow rectangular parallelepiped shape.

7. A fixing device according to claim 1, wherein said supporting metal stay has a substantially rectangular cross-section in a plane perpendicular to a longitudinal direction of said supporting metal stay extending in a direction crossing with a rotational movement direction of said belt.

8. A fixing device according to claim 1, wherein said pressing member includes a driving roller configured to apply a driving force to said belt.

9. A fixing device according to claim 1, further comprising a stretching roller around which said belt around is entrained, wherein said belt is supported by said pressing pad and said stretching roller.

* * * * *